US010309060B2

(12) United States Patent
Husband et al.

(10) Patent No.: US 10,309,060 B2
(45) Date of Patent: Jun. 4, 2019

(54) PAPER COMPOSITION

(71) Applicant: FiberLean Technologies Limited, Par Cornwall (GB)

(72) Inventors: John Claude Husband, St. Austell (GB); Per Svending, Kungalv (SE)

(73) Assignee: FIBERLEAN TECHNOLOGIES LIMITED, Par Cornwall (GB)

( * ) Notice: Subject to any disclaimer, the term of this patent is extended or adjusted under 35 U.S.C. 154(b) by 0 days.

(21) Appl. No.: 16/124,352

(22) Filed: Sep. 7, 2018

(65) Prior Publication Data

US 2019/0003121 A1 Jan. 3, 2019

Related U.S. Application Data

(62) Division of application No. 14/777,329, filed as application No. PCT/GB2014/050728 on Mar. 12, 2014, now Pat. No. 10,106,928.

(30) Foreign Application Priority Data

Mar. 15, 2013 (GB) ..... 1304717.0

(51) Int. Cl.

| | |
|---|---|
| ***D21H 11/08*** | (2006.01) |
| ***D21H 11/18*** | (2006.01) |
| ***D21H 17/00*** | (2006.01) |
| ***D21H 17/67*** | (2006.01) |
| ***D21H 17/68*** | (2006.01) |
| ***D21H 21/18*** | (2006.01) |
| ***D21B 1/12*** | (2006.01) |
| ***D21D 1/30*** | (2006.01) |
| *D21H 11/10* | (2006.01) |

(52) U.S. Cl.

CPC ..... *D21H 17/74* (2013.01); *D21B 1/12* (2013.01); *D21D 1/30* (2013.01); *D21H 11/08* (2013.01); *D21H 11/18* (2013.01); *D21H 17/68* (2013.01); *D21H 21/18* (2013.01); *D21H 11/10* (2013.01); *D21H 17/675* (2013.01)

(58) Field of Classification Search

CPC ..... D21H 11/18; D21H 19/38; D21H 11/08; D21H 5/1236; D21H 21/18; D21H 11/02; D21H 11/10; D21H 17/675; D21H 17/68; D21H 17/74; D21H 21/10; D21H 21/28; D21C 9/007; D21B 1/12; D21B 1/30; D21B 1/14; D21D 5/02; D21D 1/20; D21D 1/30; Y10T 428/31982

See application file for complete search history.

(56) References Cited

U.S. PATENT DOCUMENTS

| | | | |
|---|---|---|---|
| 4,145,246 | A | 3/1979 | Goheen et al. |
| 4,292,122 | A | 9/1981 | Karnis et al. |
| 4,298,652 | A | 11/1981 | Suzuki et al. |
| 4,456,503 | A | 6/1984 | Bystedt |
| 4,708,771 | A | 11/1987 | Beaulieu |
| 4,718,980 | A | 1/1988 | Lowrie et al. |
| 4,938,843 | A | 7/1990 | Lindhal |
| 5,145,010 | A | 9/1992 | Danielsson et al. |
| 5,576,617 | A | 11/1996 | Webb et al. |
| 5,916,417 | A | 6/1999 | Cassidy et al. |
| 6,068,732 | A | 5/2000 | Cassidy et al. |
| 6,183,596 | B1 | 2/2001 | Matsuda et al. |
| 6,202,946 | B1 | 3/2001 | Virtanen |
| 6,267,841 | B1 | 7/2001 | Burton |
| 6,387,210 | B1 | 5/2002 | Hsu et al. |
| 6,818,099 | B2 | 11/2004 | Tienvieri et al. |
| 6,878,236 | B2 | 4/2005 | Tienvieri et al. |
| 6,923,889 | B2 | 8/2005 | Huuskonen et al. |
| 7,005,034 | B1 | 2/2006 | Moberg et al. |
| 8,231,764 | B2 | 7/2012 | Husband et al. |
| 8,268,122 | B2 | 9/2012 | Walter et al. |
| 8,377,259 | B2 | 2/2013 | Kozuka et al. |
| 8,871,922 | B2 | 10/2014 | Hu et al. |
| 8,969,441 | B2 | 3/2015 | Yano et al. |
| 9,127,405 | B2 | 9/2015 | Husband et al. |
| 9,145,640 | B2 | 9/2015 | Li et al. |
| 9,222,222 | B2 | 12/2015 | Dodd |
| 9,327,426 | B2 | 5/2016 | Yano et al. |
| 10,106,928 | B2 * | 10/2018 | Husband ..... D21H 11/08 |

(Continued)

FOREIGN PATENT DOCUMENTS

| | | | |
|---|---|---|---|
| CN | 101545230 | A | 9/2009 |
| CN | 102753752 | A | 10/2012 |

(Continued)

OTHER PUBLICATIONS

Abe et al. "Obtaining Cellulose Nanofibers with a Uniform Width of 15 nm from Wood", Bio macromolecules, vol. 8, 2007, pp. 3276-3278.

(Continued)

*Primary Examiner* — Jose A Fortuna

(74) *Attorney, Agent, or Firm* — Raymond G. Arner; Pierce Atwood LLP

(57) ABSTRACT

A paper product may include high energy thermomechanical pulp (TMP), low energy TMP, and microfibrillated cellulose. The paper product may also include inorganic particulate material. A papermaking composition suitable for making the paper product, a process for preparing the paper product, and use of microfibrillated cellulose may include high energy TMP, low energy TMP, and microfibrillated cellulose, and optionally inorganic particulate material. The microfibrillated cellulose may have a fiber steepness of from about 20 to about 50 in the paper product.

9 Claims, No Drawings

(56) References Cited

U.S. PATENT DOCUMENTS

| | | | | |
|---|---|---|---|---|
| 2003/0006016 | A1 | 1/2003 | Tienvieri et al. | |
| 2003/0015305 | A1 | 1/2003 | Tienvieri et al. | |
| 2004/0231811 | A1 | 11/2004 | Engstrand et al. | |
| 2005/0194477 | A1 | 9/2005 | Suzuki | |
| 2009/0288789 | A1 | 11/2009 | Sabourin et al. | |
| 2011/0081554 | A1 | 4/2011 | Ankerfors et al. | |
| 2011/0259537 | A1 | 10/2011 | Husband et al. | |
| 2012/0012031 | A1 | 1/2012 | Husband et al. | |
| 2012/0080156 | A1 | 4/2012 | Laleg et al. | |
| 2013/0112360 | A1 | 5/2013 | Virtanen et al. | |
| 2013/0280545 | A1 | 10/2013 | Husband et al. | |
| 2014/0020856 | A1 | 1/2014 | Goto et al. | |
| 2016/0024718 | A1 | 1/2016 | Lee et al. | |
| 2016/0032531 | A1 | 2/2016 | Husband et al. | |
| 2016/0053437 | A1 | 2/2016 | Husband et al. | |
| 2016/0230341 | A1 | 8/2016 | Husband et al. | |
| 2016/0237621 | A1 | 8/2016 | Cutts | |
| 2016/0273165 | A1 | 9/2016 | Laine et al. | |
| 2019/0003121 | A1* | 1/2019 | Husband | D21H 11/08 |

FOREIGN PATENT DOCUMENTS

| | | | |
|---|---|---|---|
| EP | 0614948 | A1 | 9/1994 |
| EP | 1538257 | A1 | 6/2005 |
| EP | 2350387 | B1 | 2/2015 |
| JP | H10-98954 | A | 4/1998 |
| WO | 2010/131016 | A2 | 11/2010 |
| WO | 2012/066308 | A2 | 5/2012 |
| WO | 2012/098296 | A2 | 7/2012 |

OTHER PUBLICATIONS

The State Intellectual Property Office of China; Beijing Sanyou Intellectual Property Agency Ltd; Imerys Minerals Limited; First Notification of Office Action, Chinese Application No. 201480026932.1, dated Sep. 2, 2016, 3 pages.
Chinese 2nd Notification of Office Action, dated Apr. 28, 2017, from corresponding Chinese Patent Application No. 201480026932.1, 7 pages.
Chinese Search Report from corresponding Chinese Patent Application No. 201480026932.1, 4 pages.
Chinese Third Office Action, dated Dec. 19, 2017, from corresponding Chinese Patent Application No. 201480026932.1, 18 pages.
Chinga-Carrasco and Syverud, "Computer-Assisted Quantification of the Muli-Scale Structure of Films Made of Nanofibrillated Cellulose," J Nanopart Res (2010) 12:841-851.
"Coated-Paper Producers Look Forward to Brighter Times," Pulp & Paper International (1994) 18-31.
Crofton et al., "Dielectric Studies of Cellulose and Its Derivatives: 1. Acetylation of Cellulose," Polymer (1982) 23:1605-1608.
Esau, Katherine, "Chapter 4, Cell Wall," Anatomy of Seed Plants, 2nd Edition, (1977) pp. 43-48.
European Office Action, dated Feb. 24, 2017, from corresponding European Patent Application No. 14710376.6, 3 pages.
European Intention to Grant from corresponding European Patent Application No. 14710376.6, dated Jan. 26, 2018, 5 pages.
Fahn, A., "Plant Anatomy Fourth Edition," (1990) pp. 32-39.
Fengel, D., "Ideas on the Ultrastructure Organization of the Cell Wall Components," J. Polymer Sci.: Part C, No. 36 (1971) pp. 383-392.
Fengel et al., "Chapter 4. Cellulose," Wood Chemistry, Ultrastructure, Reactions, (1983) pp. 66-105.
Frey-Wyssling and Mühlethaler, "The Fine Structure of Cellulose." Fortschritte der Chemie Organischer Naturstoffe (1951) pp. 1-27.
Great Britain Search Report dated Sep. 17, 2013 for Great Britain Application No. GB1304717.0.
Hult et al., "Cellulose Fibril Aggregation—An Inherent Property of Kraft Pulps," Polymer 42 (2001) pp. 3309-3314.
International Search Report and Written Opinion dated Jun. 18, 2014 in International Application No. PCT/GB2014/050728.
International Preliminary Report on Patentability for International Patent Application No. PCT/GB2014/050728, dated Sep. 15, 2015, 6 pages.
Ioelovich, Michael, "Cellulose as a Nanostructured Polymer: A Short Review." BioResources, vol. 3, No. 4, 2008, pp. 1403-1418.
Japanese Office Action, dated Mar. 19, 2018, from corresponding Japanese Patent Application No. 2015-562307, 4 pages.
Manninen et al., "The Effect of Microfibrillated Cellulose Addition on Drying Shrinkage and Dimensional Stability of Wood-Free Paper," Nordic Pulp and Paper Research Journal (2011) 1-10.
McDonald et al., "The Nature of the Mechanical Pulping Process," Mechanical Pumping, 105:8, 27-32 (2004).
McGinnis and Shafizadeh, "Chapter 1 Cellulose and Hemicellulose," Pulp and Paper: Chemistry and Chemical Technology, (1980) pp. 1-38.
McGraw-Hill, "Cell Walls (Plant)," Encyclopedia of Science and Technology, 5th edition, (1982), pp. 737-741.
Pääkkö et al., ""Enzymatic Hydrolysis Combined with Mechanical Shearing and High-Pressure Homogenization for Nanoscale Cellulose Fibrils and Strong Gels."" Biomacromolecules (2007) 8, 1934-1941.
"Paper Coating Pigments," TAPPI Monograph Series No. 30 (1966) 34-35.
Pöhler, Tiina & Lappalainen, Timo & Tammelin, Tekla & Eronen, Paula & Hiekkataipale, Panu & Vehniäinen, Annikki & M. Koskinen, Timo. (2011). "Influence of fibrillation method on the character of nanofibrillated cellulose (NFC)," 2010 TAPPI International Conference on Nanotechnology for the Forest Product Industry, Dipoli Congress Centre, Espoo, Finland, Sep. 27-29, 2010, 22 pages.
Roberts, J.C., "Chapter 2, The Material of Paper," The Chemistry of Paper, RSC Paperbacks, 1996, pp. 11-25.
Roberts, J.C., "Chapter 4, The Material of Paper," The Chemistry of Paper, RSC Paperbacks, 1996, pp. 52-68.
Rowland and Roberts, "The Nature of Accessible Surfaces in the Microstructure of Cotton Cellulose," Journal of Polymer Science: Part A-1, vol. 10, (1972) pp. 2447-2461.
Saito et al. Homogeneous Suspensions of Individualized Microfibrils from TEMPO-Catalyzed Oxidation of Native Cellulose Biomacromolecules, American Chemical Society, vol. 7, No. 6 (2006) pp. 1687-1691.
Saito et al., "Cellulose Nanofibers Prepared by TEMPO-Mediated Oxidation of Native Cellulose," Biomacromolecules, (2007) 8:2485-2491.
Siró, Istvá, "Microfibrillated Cellulose and New Nanocomposite Materials: A Review," Cellulose (2010) 17:459-494.
Vena, "Thermomechanical Pulping (TMP), Chemithermomechanical Pulping (CTMP) and Biothermomechanical Pulping (BTMP) of Bugweed (*Solanum mauritianum*) and Pinus Patula," Master of Wood Science (M.Sc) at the University of Stellenbosch, 82 pages, Dec. 1, 2005.

* cited by examiner

PAPER COMPOSITION

CROSS REFERENCE TO RELATED APPLICATIONS

This application is a divisional of U.S. application Ser. No. 14/777,329, filed Sep. 15, 2015, now U.S. Pat. No. 10,106,928, which is a U.S. national phase entry under 35 U.S.C. § 371 from PCT International Application No. PCT/GB2014/050728, filed Mar. 12, 2014, which claims the benefit of priority United Kingdom Patent Application No. 1304717.0, filed Mar. 15, 2013, the subject matter of all of which is incorporated herein by reference.

TECHNICAL FIELD

The present invention relates to a paper product comprising high energy TMP, low energy TMP, microfibrillated cellulose and optionally inorganic particulate material, a papermaking composition suitable for making said paper product, a process for preparing the paper product, and to the use of microfibrillated cellulose, optionally having a fibre steepness of from about 20 to about 50, in said paper product.

BACKGROUND

Supercalendered magazine (SC) paper is typically made from thermomechanical pulp (TMP) which is refined using a relatively high energy input. High mineral loadings are also typically used in such papers. A primary purpose of the high energy pulp refining is to reduce the porosity of the paper so that acceptable ink holdout is obtained during printing on the SC paper, which is often by rotogravure. However, the high energy requirement for TMP refining is costly and less desirable from an environmental perspective. It would therefore be desirable to reduce the energy cost of producing TMP and SC paper, but without adversely affecting one or more physical properties of the SC paper.

SUMMARY OF THE INVENTION

According to a first aspect, the present invention is directed to a paper product comprising high energy TMP, low energy TMP, microfibrillated cellulose and optionally inorganic particulate material, wherein the paper product comprises at least about 30% by weight high energy TMP and low energy TMP, based on the total weight of the paper product, and wherein the weight ratio of high energy TMP to low energy TMP is from about 99:1 to about 1:99.

According to a second aspect, the present invention is directed to a papermaking composition suitable for preparing a paper-product according to the first aspect of the present invention.

According to a third aspect, the present invention is directed to a process for preparing a paper product according to the first aspect of the present invention, said process comprising: (i) combining high energy TMP, low energy TMP, microfibrillated cellulose and optional inorganic particulate in appropriate amounts to form a papermaking composition; (ii) forming a paper product from said papermaking composition, and optionally (iii) calendering and optionally supercalendering the paper product.

According to a fourth aspect, the present invention is directed to the use of microfibrillated cellulose, optionally having a fibre steepness of from about 20 to about 50, in a paper product comprising high energy TMP and low energy TMP, wherein the paper product comprises at least about 30% by weight high energy TMP and low energy TMP, based on the total weight of the paper product, wherein the weight ratio of high energy TMP to low energy TMP is from about 99:1 to about 1:99, for example, from about 99:1 to about 40:60, or from about 55:45 to about 45:55, and optionally wherein the paper product comprises up to about 50% by weight inorganic particulate material.

DETAILED DESCRIPTION OF THE INVENTION

The term "paper product", as used in connection with the present invention, should be understood to mean all forms of paper, including board such as, for example, white-lined board and linerboard, cardboard, paperboard, coated board, and the like. There are numerous types of paper, coated or uncoated, which may be made according to the present invention, including paper suitable for books, magazines, newspapers and the like, and office papers. The paper may be calendered or supercalendered as appropriate; for example super calendered magazine paper for rotogravure and offset printing may be made according to the present methods. Paper suitable for light weight coating (LWC), medium weight coating (MWC) or machine finished pigmentisation (MFP) may also be made according to the present methods. Coated paper and board having barrier properties suitable for food packaging and the like may also be made according to the present methods.

As used herein, the term "thermomechanical pulp (TMP)" means a pulp produced by heating, e.g., with steam, a cellulose-containing material and mechanically treating the heated material in a pressurized refiner. In an exemplary process, a cellulose-containing material is steamed, e.g., with recycled process steam, and the steamed material is passed to a pressurized refiner which separates the fibre via mechanical means, e.g., between rotating disc plates. The process steam is then separated from the pulp, e.g., in a cyclone following the refiner, and the pulp is then screened and cleaned. Thermomechanical pulp is a recognised term of art and a person of skill in the art understands that a thermomechanical pulp is a relatively specific type of pulp, distinct from other types of pulp, such as, for example, chemical pulp, groundwood pulp, and chemithermomechanical pulp. The cellulose-containing material may be derived from any suitable source, such as wood, grasses (e.g., sugarcane, bamboo) or rags (e.g., textile waste, cotton, hemp or flax). In certain embodiments, the cellulose-containing material is grass or wood, for example, softwood, typically in the form of wood chips.

As used herein, the terms "high energy" and "low energy" are used to distinguish TMP depending on the total energy input during the pulp refining process. The total energy input is based on the total dry weight of fibre in the pulp. Thus, a "high energy TMP" is obtained from a refining process which has a total energy input which is greater than the total energy input in a refining process for producing a "low energy TMP".

As used herein, the term "total energy input" means the energy input in all refining stages of the TMP refining process, i.e., beginning with the heating of the cellulose-containing material through to the stage at which the mechanically treated material exits the refiner (i.e., not including the step of removing heat, e.g., steam from the pulp and subsequent process steps).

In certain embodiments, the high energy TMP is obtained from TMP refining process in which the total energy input is equal to or greater than 2.5 $MWht^{-1}$, based on the total dry weight of fibre in the pulp, and/or the low energy TMP is obtained from a TMP refining process in which the total energy input is less than 2.5 $MWht^{-1}$, based on the total dry weight of the fibre in the pulp.

In certain embodiments, the high energy TMP is obtained from a TMP refining process in which the total energy input is equal to or greater than about 2.6 $MWht^{-1}$, for example, equal to or greater than about 2.7 $MWht^{-1}$, or equal to or greater than about 2.8 $MWht^{-1}$, or equal to or greater than about 2.9 $MWht^{-1}$, or equal to or greater than about 3.0 $MWht^{-1}$, or equal to or greater than about 3.1 $MWht^{-1}$, or equal to or greater than about 3.2 $MWht^{-1}$, or equal to or greater than about 3.3 $MWht^{-1}$, or equal to or greater than about 3.4 $MWht^{-1}$, or equal to or greater than about 3.5 $MWht^{-1}$. In certain embodiments, the total energy input ranges from 2.5 $MWht^{-1}$ to about 3.5 $MWht^{-1}$, for example, from about 2.6 $MWht^{-1}$ to about 3.3 $MWht^{-1}$, or from about 2.7 $MWht^{-1}$ to about 3.2 $MWht^{-1}$, or from about 2.8 $MWht^{-1}$ to about 3.1 $MWht^{-1}$, or from about 2.8 $MWht^{-1}$ to about 3.0 $MWht^{-1}$. In certain embodiments, total energy input is no greater than about 4.0 $MWht^{-1}$, for example, no greater than about 3.5 $MWht^{-1}$, or no greater than about 3.2 $MWht^{-1}$, or no greater than about 3.0 $MWht^{-1}$.

In certain embodiments, the high energy TMP has a Canadian standard freeness (CSF) of from about 10 to about 60 $cm^3$, for example, from about 20 to about 50 $cm^3$, or from about 30 to about 40 $cm^3$. In certain embodiments, the high energy TMP is obtained from a TMP refining process in which the total energy input is from about 2.7 $MWht^{-1}$ to about 3.2 $MWht^{-1}$ and has a CSF of from about 30 to about 40 $cm^3$.

In certain embodiments, the low energy TMP is obtained from a TMP refining process in which the total energy input is less than 2.5 $MWht^{-1}$, for example, equal to or less than about 2.4 $MWht^{-1}$, or equal to or less than about 2.3 $MWht^{-1}$, or equal to or less than about 2.2 $MWht^{-1}$, or equal to or less than about 2.1 $MWht^{-1}$, or equal to or less than about 2.0 $MWht^{-1}$, or equal to or less than about 1.9 $MWht^{-1}$, or equal to or less than about 1.8 $MWht^{-1}$, or equal to or less than about 1.7 $MWht^{-1}$, or equal to or less than about 1.6 $MWht^{-1}$, or equal to or less than about 1.5 $MWht^{-1}$. In certain embodiments, the total energy input ranges from 1.5 $MWht^{-1}$ to 2.5 $MWht^{-1}$, for example, from about 1.6 $MWht^{-1}$ to about 2.4 $MWht^{-1}$, or from about 1.7 $MWht^{-1}$ to about 2.3 $MWht^{-1}$, or from about 1.8 $MWht^{-1}$ to about 2.2 $MWht^{-1}$, or from about 1.8 $MWht^{-1}$ to about 2.1 $MWht^{-1}$, or from about 1.8 $MWht^{-1}$ to about 2.0 $MWht^{-1}$. In certain embodiments, total energy input is no less than about 1.0 $MWht^{-1}$, for example, no less than about 1.5 $MWht^{-1}$, or no less than about 1.8 $MWht^{-1}$.

In certain embodiments, the low energy TMP has a CSF of from about 80 to about 130 $cm^3$, for example, from about 90 to about 120 $cm^3$, or from about 100 to about 110 $cm^3$. In certain embodiments, the low energy TMP is obtained from a TMP refining process in which the total energy input is from about 1.8 $MWht^{-1}$ to about 2.2 $MWht^{-1}$ and has a CSF of from about 100 to about 110 $cm^3$.

In certain embodiments, the difference in total energy input between the TMP refining process used to obtain the high energy TMP and the TMP refining process used to obtain the low energy TMP is at least about 0.1 $MWht^{-1}$, for example, at least about, 0.2 $MWht^{-1}$, or at least about 0.3 $MWht^{-1}$, or at least about 0.4 $MWht^{-1}$, or at least about 0.5 $MWht^{-1}$, or at least about 0.6 $MWht^{-1}$, or at least about 0.7 $MWht^{-1}$, or at least about 0.8 $MWht^{-1}$, or at least about 0.9 $MWht^{-1}$, or at least about 1.0 $MWht^{-1}$, or at least about 1.1 $MWht^{-1}$, or at least about 1.2 $MWht^{-1}$, or at least about 1.3 $MWht^{-1}$, or at least about 1.5 $MWht^{-1}$. In certain embodiments, the difference in total energy input is no more than about 2.0 $MWht^{-1}$. In said embodiments, the low energy TMP is obtained from a TMP refining process in which the total energy input is less than 2.5 $MWht^{-1}$, for example, less than about 2.0 $MWht^{-1}$. Advantageously, the difference in total energy input between the TMP refining process used to obtain the high energy TMP and the TMP refining process used to obtain the low energy TMP is at least about 0.8 $MWht^{-1}$, for example, at least about 1.0 $MWht^{-1}$, optionally no greater than about 1.5 $MWht^{-1}$, or no greater than about 1.2 $MWht^{-1}$.

In certain embodiments, the high energy TMP is obtained from a TMP refining process in which the total energy input is equal to or greater than about 2.7 $MWht^{-1}$, for example, equal to or greater than about 2.8 $MWht^{-1}$, or equal to or greater than about 2.9 $MWht^{-1}$ and the low energy TMP is obtained from a TMP refining process in which the total energy input is equal to or less than about 2.1 $MWht^{-1}$, for example, equal to or less than about 2.0 $MWht^{-1}$, or equal to or less than about 1.9 $MWht^{-1}$.

The paper product comprises at least about 30% by weight high energy TMP and low energy TMP, i.e., the total weight of high energy TMP and low energy TMP is at least about 30% by weight, based on the total weight of the paper product. In certain embodiments, the paper product comprises at least about 35% by weight high energy TMP and low energy TMP, for example, at least about 40% by weight, or at least about 45% by weight hat least about 50% by weight, or at least about 55% by weight, or at least about 60% by weight, or at least about 65% by weight, or at least about 65% by weight, or at least about 70% by weight, or at least about 75% by weight, or at least about 80% by weight high energy TMP and low energy TMP. In certain embodiment, the paper product comprises from about 30 to about 90% by weight high energy TMP and low energy TMP, for example, from about 40 to about 85% by weight high energy TMP and low energy TMP, or from about 40 to about 80% by weight, or from about 45 to about 75% by weight, or from about 50 to about 70% by weight, or from about 55 to about 75% by weight, or from about 50 to about 75% by weight, or from about 60 about 80% by weight, or from about 65 to about 80% by weight high energy TMP and low energy TMP.

The weight ratio of high energy TMP to low energy TMP is from about 99:1 to about 1:99, for example, from about 99:1 to about 10:90, or from about 99:1 to about 20:80, or from about 99:1 to about 30:70, or from about 99:1 to about 40:60, or from about 99:5 to about 40:60, or from about 90:10 to about 45:55, or from about 90:10 to about 50:50, or from about 90:10 to about 42:58, or from about 85:15 to about 44:56, or from about 80:20 to about 46:54, or from about 75:25 to about 48:52, or from about 70:30 to about 50:50, or from about 65:35 to about 50:50, or from about 60:40 to about 50:50, or from about 55:45 to about 50:50.

In certain embodiments, the paper product comprise up to about 20% by weight of fibrous pulp material other than TMP. For example, the paper product may comprise pulp prepared by any suitable chemical or mechanical treatment, or combination thereof. For example, the pulp may be a chemical pulp, or a chemithermomechanical pulp, or a mechanical pulp, or a recycled pulp, or a papermill broke, or a papermill waste stream, or waste from a papermill, or a combination thereof. In certain embodiments, the paper product comprises up to about 15% by weight of a fibrous pulp material other than TMP, for example, up to about 10% by weight, or up to about 5% by weight, or up to about 2% by weight, or up to about 1% by weight of a fibrous pulp material other than TMP.

In certain embodiments, the paper product comprises from about 0.1 to about 5 wt. % microfibrillated cellulose, based on the total weight of the paper product.

The microfibrillated cellulose may be derived from any suitable source. In certain embodiments, the composition comprising microfibrillated cellulose is obtainable by a process comprising microfibrillating a fibrous substrate comprising cellulose in the presence of a grinding medium. The process is advantageously conducted in an aqueous environment.

In certain embodiments, the composition comprises microfibrillated cellulose and inorganic particulate material and the composition is obtainable by a process comprising microfibrillating a fibrous substrate comprising cellulose in the presence of said inorganic particulate material and a grinding medium.

By "microfibrillating" is meant a process in which microfibrils of cellulose are liberated or partially liberated as individual species or as small aggregates as compared to the fibres of the pre-microfibrillated pup. Typical cellulose fibres (i.e., pre-microfibrillated pulp) suitable for use in papermaking include larger aggregates of hundreds or thousands of individual cellulose fibrils. By microfibrillating the cellulose, particular characteristics and properties, including the characteristics and properties described herein, are imparted to the microfibrillated cellulose and the compositions comprising the microfibrillated cellulose. As discussed in the background section above, it is desirable to reduce the energy cost of producing TMP and, thus, the manufacturing cost of SC paper. One option is to reduce the energy used to produce the TMP, i.e., using TMP obtained from a lower energy TMP pulp refining process. However, it has been found that the replacement of a portion of conventional, high energy TMP, with a lower energy TMP may adversely affect one or more physical properties of the SC paper, e.g., increased porosity (which can lead to inferior ink hold out) and reduced strength. Advantageously, the present inventors have surprisingly found that addition of microfibrillated cellulose to a paper product comprising high energy TMP and low energy TMP can wholly or at least partially ameliorate any deterioration in one or more physical properties of the paper product. Thus, for example, microfibrillated cellulose can be used in the paper products of the present invention to reduce the porosity of the paper product to levels commensurate with a paper product formed exclusively from conventional, high energy TMP. The overall effect is to reduce the energy costs of TMP production and, thus, SC paper production.

The microfibrillating is carried out in the presence of grinding medium which acts to promote microfibrillation of the pre-microfibrillated cellulose. In addition, when present, the inorganic particulate material may act as a microfibrillating agent, i.e., the cellulose starting material can be microfibrillated at relatively lower energy input when it is co-processed, e.g., co-ground, in the presence of an inorganic particulate material.

The fibrous substrate comprising cellulose may be derived from any suitable source, such as wood, grasses (e.g., sugarcane, bamboo) or rags (e.g., textile waste, cotton, hemp or flax). The fibrous substrate comprising cellulose may be in the form of a pulp (i.e., a suspension of cellulose fibres in water), which may be prepared by any suitable chemical or mechanical treatment, or combination thereof. For example, the pulp may be a chemical pulp, or a chemithermomechanical pulp, or a mechanical pulp, or a recycled pulp, or a papermill broke, or a papermill waste stream, or waste from a papermill, or a combination thereof. The cellulose pulp may be beaten (for example in a Valley beater) and/or otherwise refined (for example, processing in a conical or plate refiner) to any predetermined freeness, reported in the art as Canadian standard freeness (CSF) in $cm^3$. CSF means a value for the freeness or drainage rate of pulp measured by the rate that a suspension of pulp may be drained. For example, the cellulose pulp may have a Canadian standard freeness of about 10 $cm^3$ or greater prior to being microfibrillated. The cellulose pulp may have a CSF of about 700 $cm^3$ or less, for example, equal to or less than about 650 $cm^3$, or equal to or less than about 600 $cm^3$, or equal to or less than about 550 $cm^3$, or equal to or less than about 500 $cm^3$, or equal to or less than about 450 $cm^3$, or equal to or less than about 400 $cm^3$, or equal to or less than about 350 $cm^3$, or equal to or less than about 300 $cm^3$, or equal to or less than about 250 $cm^3$, or equal to or less than about 200 $cm^3$, or equal to or less than about 150 $cm^3$, or equal to or less than about 100 $cm^3$, or equal to or less than about 50 $cm^3$. The cellulose pulp may then be dewatered by methods well known in the art, for example, the pulp may be filtered through a screen in order to obtain a wet sheet comprising at least about 10% solids, for example at least about 15% solids, or at least about 20% solids, or at least about 30% solids, or at least about 40% solids. The pulp may be utilised in an unrefined state, that is to say without being beaten or dewatered, or otherwise refined.

The fibrous substrate comprising cellulose may be added to a grinding vessel in a dry state. For example, a dry paper broke may be added directly to the grinder vessel. The aqueous environment in the grinder vessel will then facilitate the formation of a pulp.

The step of microfibrillating may be carried out in any suitable apparatus, including but not limited to a refiner. In one embodiment, the microfibrillating step is conducted in a grinding vessel under wet-grinding conditions. In another embodiment, the microfibrillating step is carried out in a homogenizer.

wet-grinding

The grinding is an attrition grinding process in the presence of a particulate grinding medium. By grinding medium is meant a medium other than the inorganic particulate material which is optionally co-ground with the fibrous substrate comprising cellulose.

It will be understood that the grinding medium is removed after the completion of grinding.

In certain embodiments, the microfibrillating process, e.g., grinding, is carried out in the absence of grindable inorganic particulate material.

The particulate grinding medium may be of a natural or a synthetic material. The grinding medium may, for example, comprise balls, beads or pellets of any hard mineral, ceramic or metallic material. Such materials may include, for example, alumina, zirconia, zirconium silicate, aluminium silicate, mullite, or the mullite-rich material which is produced by calcining kaolinitic clay at a temperature in the range of from about 1300° C. to about 1800° C.

In certain embodiment, the particulate grinding medium comprises particles having an average diameter in the range of from about 0.1 mm to about 6.0 mm and, more preferably, in the range of from about 0.2 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge. In certain embodiments, the grinding medium is present in an amount from about 30 to about 70% by volume of the charge, for example, from about 40 to about 60% by volume of the charge, for example, from about 45 to about 55% by volume of the charge.

By 'charge' is meant the composition which is the feed fed to the grinder vessel. The charge includes water, grinding media, fibrous substrate comprising cellulose and inorganic particulate material, and any other optional additives as described herein.

In certain embodiments, the grinding medium is a media comprising particles having an average diameter in the range of from about 0.5 mm to about 6 mm, for example, from about 1 mm to about 6 mm, or about 1 mm, or about 2 mm, or about 3 mm, or about 4 mm, or about 5 mm.

The grinding media may have a specific gravity of at least about 2.5, for example, at least about 3, or at least about 3.5, or at least about 4.0, or at least about 4.5, or least about 5.0, or at least about 5.5, or at least about 6.0.

In certain embodiments, the grinding media comprises particles having an average diameter in the range of from about 1 mm to about 6 mm and has a specific gravity of at least about 2.5.

In certain embodiments, the grinding media comprises particles having an average diameter of about 3 mm.

In one embodiment, the mean particle size ($d_{50}$) of the inorganic particulate material is reduced during the co-grinding process. For example, the $d_{50}$ of the inorganic particulate material may be reduced by at least about 10% (as measured by the well known conventional method employed in the art of laser light scattering, using a Malvern Mastersizer S machine), for example, the $d_{50}$ of the inorganic particulate material may be reduced by at least about 20%, or reduced by at least about 30%, or reduced by at least about 50%, or reduced by at least about 50%, or reduced by at least about 60%, or reduced by at least about 70%, or reduced by at least about 80%, or reduced by at least about 90%. For example, an inorganic particulate material having a $d_{50}$ of 2.5 μm prior to co-grinding and a $d_{50}$ of 1.5 μm post co-grinding will have been subject to a 40% reduction in particle size. In certain embodiments, the mean particle size of the inorganic particulate material is not significantly reduced during the co-grinding process. By 'not significantly reduced' is meant that the $d_{50}$ of the inorganic particulate material is reduced by less than about 10%, for example, the $d_{50}$ of the inorganic particulate material is reduced by less than about 5% during the co-grinding process.

The fibrous substrate comprising cellulose may be microfibrillated to obtain microfibrillated cellulose having a $d_{50}$ ranging from about 5 to μm about 500 μm, as measured by laser light scattering. The fibrous substrate comprising cellulose may be microfibrillated to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

The fibrous substrate comprising cellulose may be microfibrillated in the presence of an inorganic particulate material to obtain microfibrillated cellulose having a fibre steepness equal to or greater than about 10, as measured by Malvern. Fibre steepness (i.e., the steepness of the particle size distribution of the fibres) is determined by the following formula:

$$\text{Steepness}=100\times(d_{30}/d_{70})$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

Procedures to determine the particle size distributions of minerals and microfibrillated cellulose are described in WO-A-2010/131016, the entire contents of which are incorporated herein by reference. Specifically, suitable procedures are described at page 40. line 32 to page 41, line 34 of WO-A-2010/131016

The grinding may be performed in a vertical mill or a horizontal mill.

In certain embodiments, the grinding is performed in a grinding vessel, such as a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In one embodiment, the grinding vessel is a vertical mill, for example, a stirred mill, or a stirred media detritor, or a tower mill.

The vertical mill may comprise a screen above one or more grind zones. In an embodiment, a screen is located adjacent to a quiescent zone and/or a classifier. The screen may be sized to separate grinding media from the product aqueous suspension comprising microfibrillated cellulose and inorganic particulate material and to enhance grinding media sedimentation.

In another embodiment, the grinding is performed in a screened grinder, for example, a stirred media detritor. The screened grinder may comprise one or more screen(s) sized to separate grinding media from the product aqueous suspension comprising microfibrillated cellulose and inorganic particulate material.

In certain embodiments, the fibrous substrate comprising cellulose and inorganic particulate material are present in the aqueous environment at an initial solids content of at least about 4 wt %, of which at least about 2% by weight is fibrous substrate comprising cellulose. The initial solids content may be at least about 10 wt %, or at least about 20 wt %, or at least about 30 wt %, or at least about at least 40 wt %. At least about 5% by weight of the initial solids content may be fibrous substrate comprising cellulose, for example, at least about 10%, or at least about 15%, or at least about 20% by weight of the initial solids content may be fibrous substrate comprising cellulose. Generally, the relative amounts of fibrous substrate comprising cellulose and inorganic particulate material are selected in order to obtain a composition comprising microfibrillated cellulose and inorganic particulate according to the first aspect of the invention.

The grinding process may include a pre-grinding step in which coarse inorganic particulate is ground in a grinder vessel to a predetermined particle size distribution, after which fibrous material comprising cellulose is combined with the pre-ground inorganic particulate material and the grinding continued in the same or different grinding vessel until the desired level of microfibrillation has been obtained.

As the suspension of material to be ground may be of a relatively high viscosity, a suitable dispersing agent may be added to the suspension prior to or during grinding. The dispersing agent may be, for example, a water soluble condensed phosphate, polysilicic acid or a salt thereof, or a polyelectrolyte, for example a water soluble salt of a poly (acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethyl cellulose, amphoteric carboxymethyl cellulose, oxidising agents, 2,2,6,6-Tetramethylpiperidine-1-oxyl (TEMPO), TEMPO derivatives, and wood degrading enzymes.

In certain embodiments, the product of the co-grinding process is treated to remove at least a portion or substantially all of the water to form a partially dried or essentially completely dried product. For example, at least about 10% by volume, for example, at least about 20% by volume, or at least about 30% by volume, or least about 40% by volume, or at least about 50% by volume, or at least about 60% by volume, or at least about 70% by volume or at least about 80% by volume or at least about 90% by volume, or at least about 100% by volume of water in product of the co-grinding process may be removed. Any suitable technique can be used to remove water from the product including, for example, by gravity or vacuum-assisted drainage, with or without pressing, or by evaporation, or by filtration, or by a combination of these techniques. The partially dried or essentially completely dried product will comprise microfibrillated cellulose and inorganic particulate material and any other optional additives that may have been added prior to drying. The partially dried or essentially completely dried product may be optionally re-hydrated and incorporated in papermaking compositions and paper products, as described herein.

When present, the amount of inorganic particulate material and cellulose pulp in the mixture to be co-ground may vary in a ratio of from about 99.5:0.5 to about 0.5:99.5, based on the dry weight of inorganic particulate material and the amount of dry fibre in the pulp, for example, a ratio of from about 99.5:0.5 to about 50:50 based on the dry weight of inorganic particulate material and the amount of dry fibre in the pulp. For example, the ratio of the amount of inorganic particulate material and dry fibre may be from about 99.5:0.5 to about 70:30. In certain embodiments, the weight ratio of inorganic particulate material to dry fibre is about 95:5. In another embodiment, the weight ratio of inorganic particulate material to dry fibre is about 90:10. In another embodiment, the weight ratio of inorganic particulate material to dry fibre is about 85:15. In another embodiment, the weight ratio of inorganic particulate material to dry fibre is about 80:20. In yet another embodiment, the weight ratio of inorganic particulate material to dry fibre is about 50:50.

In an exemplary microfibrillation process, the total energy input per tonne of dry fibre in the fibrous substrate comprising cellulose will be less than about 10,000 $kWht^{-1}$, for example, less than about 9000 $kWht^{-1}$, or less than about 8000 $kWht^{-1}$, or less than about 7000 $kWht^{-1}$, or less than about 6000 $kWht^{-1}$, or less than about 5000 $kWht^{-1}$, for example less than about 4000 $kWht^{-1}$, less than about 3000 $kWht^{-1}$, less than about 2000 $kWht^{-1}$, less than about 1500 $kWht^{-1}$, less than about 1200 $kWht^{-1}$, less than about 1000 $kWht^{-1}$, or less than about 800 $kWht^{-1}$. The total energy input varies depending on the amount of dry fibre in the fibrous substrate being microfibrillated, and optionally the speed of grind and the duration of grind.

In certain embodiments, the paper product comprises from about 0.1 to about 5 wt. % to about 4.5 wt % microfibrillated cellulose, for example, from about 0.1 to about 4.0 wt. % microfibrillated cellulose, or from about 0.1 to about 3.5 wt. % microfibrillated cellulose, or from about 0.1 to about 3.0 wt % microfibrillated cellulose, or from about 0.25 to about 3.0 wt. % microfibrillated cellulose, or from about 0.25 to about 2.8 wt. % microfibrillated cellulose, or from about 0.4% to about 2.7 wt. % microfibrillated cellulose, or from about 0.5 to about 3.0 wt. % microfibrillated cellulose, or from about 0.75 to about 3.0 wt. % microfibrillated cellulose, or from about 1.0 to about 3.0 wt. % microfibrillated cellulose, or from about 1.25 to about 3.0 wt. % microfibrillated cellulose, or from about 1.5 to about 3.0 wt. % microfibrillated cellulose, or from about 2.0 to about 3.0 wt. % microfibrillated cellulose, or from about 2.0 to about 2.8 wt. % microfibrillated cellulose, or from about 2.2 to about 2.7 wt. % microfibrillated cellulose.

In certain embodiments, the paper product comprises at least about 50 wt. % high energy TMP and low energy TMP, from about 1.0 to about 3.0 wt. % microfibrillated cellulose, and optionally up to about 50% by weight inorganic particulate material.

In certain embodiments, the paper product comprises up to about 50% by weight inorganic particulate material, based on the total weight of the paper product. As discussed above, the inorganic particulate material, when present, may be derived from the process of obtaining microfibrillated cellulose. In other embodiments, the inorganic particulate material is nor derived from the process of obtaining microfibrillated cellulose and is added separately. In other embodiment, a portion of the inorganic particulate material is derived from the process of obtaining microfibrillated cellulose and a portion of the inorganic particulate material is added separately.

The inorganic particulate material may, for example, be an alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, perlite or diatomaceous earth, or magnesium hydroxide, or aluminium trihydrate, or combinations thereof.

In certain embodiments, the inorganic particulate material comprises or is calcium carbonate. Hereafter, the invention may tend to be discussed in terms of calcium carbonate, and in relation to aspects where the calcium carbonate is processed and/or treated. The invention should not be construed as being limited to such embodiments.

The particulate calcium carbonate used in the present invention may be obtained from a natural source by grinding. Ground calcium carbonate (GCC) is typically obtained by crushing and then grinding a mineral source such as chalk, marble or limestone, which may be followed by a particle size classification step, in order to obtain a product having the desired degree of fineness. Other techniques such as bleaching, flotation and magnetic separation may also be used to obtain a product having the desired degree of fineness and/or colour. The particulate solid material may be ground autogenously, i.e. by attrition between the particles of the solid material themselves, or, alternatively, in the presence of a particulate grinding medium comprising particles of a different material from the calcium carbonate to be ground. These processes may be carried out with or without the presence of a dispersant and biocides, which may be added at any stage of the process.

Precipitated calcium carbonate (PCC) may be used as the source of particulate calcium carbonate in the present invention, and may be produced by any of the known methods available in the art. TAPPI Monograph Series No 30, "Paper Coating Pigments", pages 34-35 describes the three main commercial processes for preparing precipitated calcium carbonate which is suitable for use in preparing products for use in the paper industry, but may also be used in the practice of the present invention. In all three processes, a calcium carbonate feed material, such as limestone, is first calcined to produce quicklime, and the quicklime is then slaked in water to yield calcium hydroxide or milk of lime. In the first process, the milk of lime is directly carbonated with carbon dioxide gas. This process has the advantage that no by-product is formed, and it is relatively easy to control the properties and purity of the calcium carbonate product. In the second process the milk of lime is contacted with soda ash to produce, by double decomposition, a precipitate of calcium carbonate and a solution of sodium hydroxide. The sodium hydroxide may be substantially completely separated from the calcium carbonate if this process is used commercially. In the third main commercial process the milk of lime is first contacted with ammonium chloride to give a calcium chloride solution and ammonia gas. The calcium chloride solution is then contacted with soda ash to produce by double decomposition precipitated calcium carbonate and a solution of sodium chloride. The crystals can be produced in a variety of different shapes and sizes, depending on the specific reaction process that is used. The three main forms of PCC crystals are aragonite, rhombohedral and scalenohedral, all of which are suitable for use in the present invention, including mixtures thereof.

Wet grinding of calcium carbonate involves the formation of an aqueous suspension of the calcium carbonate which may then be ground, optionally in the presence of a suitable dispersing agent. Reference may be made to, for example, EP-A-614948 (the contents of which are incorporated by reference in their entirety) for more information regarding the wet grinding of calcium carbonate.

In some circumstances, minor additions of other minerals may be included, for example, one or more of kaolin, calcined kaolin, wollastonite, bauxite, talc or mica, could also be present.

When the inorganic particulate material is obtained from naturally occurring sources, it may be that some mineral impurities will contaminate the ground material. For example, naturally occurring calcium carbonate can be present in association with other minerals. Thus, in some embodiments, the inorganic particulate material includes an amount of impurities. In general, however, the inorganic particulate material used in the invention will contain less than about 5% by weight, preferably less than about 1% by weight, of other mineral impurities.

The inorganic particulate material may have a particle size distribution such that at least about 10% by weight, for example at least about 20% by weight, for example at least about 30% by weight, for example at least about 40% by weight, for example at least about 50% by weight, for example at least about 60% by weight, for example at least about 70% by weight, for example at least about 80% by weight, for example at least about 90% by weight, for example at least about 95% by weight, or for example about 100% of the particles have an e.s.d of less than 2 μm.

In certain embodiments, at least about 50% by weight of the particles have an e.s.d of less than 2 μm, for example, at least about 55% by weight of the particles have an e.s.d of less than 2 μm, or at least about 60% by weight of the particles have an e.s.d of less than 2 μm.

Unless otherwise stated, particle size properties referred to herein for the inorganic particulate materials are as measured in a well known manner by sedimentation of the particulate material in a fully dispersed condition in an aqueous medium using a Sedigraph 5100 machine as supplied by Micromeritics Instruments Corporation, Norcross, Ga., USA (web-site: www.micromeritics.com), referred to herein as a "Micromeritics Sedigraph 5100 unit". Such a machine provides measurements and a plot of the cumulative percentage by weight of particles having a size, referred to in the art as the 'equivalent spherical diameter' (e.s.d), less than given e.s.d values. The mean particle size $d_{50}$ is the value determined in this way of the particle e.s.d at which there are 50% by weight of the particles which have an equivalent spherical diameter less than that $d_{50}$ value.

Alternatively, where stated, the particle size properties referred to herein for the inorganic particulate materials are as measured by the well known conventional method employed in the art of laser light scattering, using a Malvern Mastersizer S machine as supplied by Malvern Instruments Ltd (or by other methods which give essentially the same result). In the laser light scattering technique, the size of particles in powders, suspensions and emulsions may be measured using the diffraction of a laser beam, based on an application of Mie theory. Such a machine provides measurements and a plot of the cumulative percentage by volume of particles having a size, referred to in the art as the 'equivalent spherical diameter' (e.s.d), less than given e.s.d values. The mean particle size $d_{50}$ is the value determined in this way of the particle e.s.d at which there are 50% by volume of the particles which have an equivalent spherical diameter less than that $d_{50}$ value.

Thus, in another embodiment, the inorganic particulate material may have a particle size distribution, as measured by the well known conventional method employed in the art of laser light scattering, such that at least about 10% by volume, for example at least about 20% by volume, for example at least about 30% by volume, for example at least about 40% by volume, for example at least about 50% by volume, for example at least about 60% by volume, for example at least about 70% by volume, for example at least about 80% by volume, for example at least about 90% by volume, for example at least about 95% by volume, or for example about 100% by volume of the particles have an e.s.d of less than 2 μm.

In certain embodiments, at least about 50% by volume of the particles have an e.s.d of less than 2 μm, for example, at least about 55% by volume of the particles have an e.s.d of less than 2 μm, or at least about 60% by volume of the particles have an e.s.d of less than 2 μm. In certain embodiments, from about 30% to about 70% by volume of the particles have an e.s.d of less than 2 μm, for example, from about 35% to about 65% by volume, or from about 40% to about 60% by volume, or from about 45 to about 60% by volume, or from about 50% to about 60% by volume of the particles have an e.s.d of less than 2 μm.

Details of the procedure that may be used to characterise the particle size distributions of mixtures of inorganic particle material and microfibrillated cellulose using the well known conventional method employed in the art of laser light scattering are discussed above.

In certain embodiments, the inorganic particulate material is kaolin clay. Hereafter, this section of the specification may tend to be discussed in terms of kaolin, and in relation to aspects where the kaolin is processed and/or treated. The invention should not be construed as being limited to such embodiments. Thus, in some embodiments, kaolin is used in an unprocessed form.

Kaolin clay used in this invention may be a processed material derived from a natural source, namely raw natural kaolin clay mineral. The processed kaolin clay may typically contain at least about 50% by weight kaolinite. For example, most commercially processed kaolin clays contain greater than about 75% by weight kaolinite and may contain greater than about 90%, in some cases greater than about 95% by weight of kaolinite.

Kaolin clay used in the present invention may be prepared from the raw natural kaolin clay mineral by one or more other processes which are well known to those skilled in the art, for example by known refining or beneficiation steps.

For example, the clay mineral may be bleached with a reductive bleaching agent, such as sodium hydrosulfite. If sodium hydrosulfite is used, the bleached clay mineral may optionally be dewatered, and optionally washed and again optionally dewatered, after the sodium hydrosulfite bleaching step.

The clay mineral may be treated to remove impurities, e. g. by flocculation, flotation, or magnetic separation techniques well known in the art. Alternatively the clay mineral used in the first aspect of the invention may be untreated in the form of a solid or as an aqueous suspension.

The process for preparing the particulate kaolin clay used in the present invention may also include one or more comminution steps, e.g., grinding or milling. Light comminution of a coarse kaolin is used to give suitable delamination thereof. The comminution may be carried out by use of beads or granules of a plastic (e. g. nylon), sand or ceramic grinding or milling aid. The coarse kaolin may be refined to remove impurities and improve physical properties using well known procedures. The kaolin clay may be treated by a known particle size classification procedure, e.g., screening and centrifuging (or both), to obtain particles having a desired $d_{50}$ value or particle size distribution.

In certain embodiments, the particulate kaolin has a steepness equal to or greater than about 10, as measured by Malvern. Particle steepness (i.e., the steepness of the particle size distribution of the kaolin particulate) is determined by the following formula:

$$\text{Steepness}=100\times(d_{30}/d_{70})$$

The particulate kaolin may have a steepness equal to or less than about 50. The particulate kaolin may have a steepness of from about 15 to about 45, for example, from about 20 to about 40, or from about 25 to about 35, or from about 20 to about 35, or from about 25 to about 40, or from about 20 to about 30, or from about 30 to about 40.

Additionally or alternatively, the particulate kaolin may have a shape factor of from about 10 to about 70. "Shape factor", as used herein, is a measure of the ratio of particle diameter to particle thickness for a population of particles of varying size and shape as measured using the electrical conductivity methods, apparatuses, and equations described in U.S. Pat. No. 5,576,617, which is incorporated herein by reference. As the technique for determining shape factor is further described in the '617 patent, the electrical conductivity of a composition of an aqueous suspension of orientated particles under test is measured as the composition flows through a vessel. Measurements of the electrical conductivity are taken along one direction of the vessel and along another direction of the vessel transverse to the first direction. Using the difference between the two conductivity measurements, the shape factor of the particulate material under test is determined.

The particulate kaolin may have a shape factor of from about 15 to about 65, for example, from about 20 to about 60, or from about 20 to about 55, or from about 30 to about 60, or from about 40 to about 60, or from about 50 to about 60, or from about 30 to about 55, or from about 35 to about 55 or from about 40 to about 55.

Additionally, particulate kaolin having a steepness and/or shape described above may have a have a particle size distribution such that from about 30% to about 70% by volume of the particles have an e.s.d of less than 2 μm, for example, from about 35% to about 65% by volume, or from about 40% to about 60% by volume, or from about 45 to about 60% by volume, or from about 50% to about 60% by volume of the particles have an e.s.d of less than 2 μm.

Without being bound by a particular theory, it is believed that such relatively coarse kaolins have been found to be particularly suitable for supercalendered papers because they tend to migrate to the surfaces of the paper and align along the same plane during calendaring.

In embodiments in which the inorganic particulate material is derived from the process for obtaining microfibrillated cellulose, the composition comprising microfibrillated cellulose and inorganic particulate may have a Brookfield viscosity (at 10 rpm) of from about 5,000 to 12,000 MPa·s, for example, from about 7,500 to about 11,000 MPa·s, or from about 8,000 to about 10,000 MPa·s, or from about 8,500 to about 9,500 MPa·s. Brookfield viscosity is determined in accordance with the following procedure. A sample of the composition, e.g., the grinder product is diluted with sufficient water to give a fibre content of 1.5 wt. %. The diluted sample is then mixed well and its viscosity measured using a Brookfield R.V. viscometer (spindle No 4) at 10 rpm. The reading is taken after 15 seconds to allow the sample to stabilise.

In certain embodiments, the paper product comprises from about 1 to about 50% by weight inorganic particulate material, for example, from about 5 to about 45% by weight inorganic particulate material, or from about 10 to about 45% by weight inorganic particulate material, or from about 15 to about 45% by weight inorganic particulate material, or from about 20 to about 45% by weight inorganic particulate material, or from about 25 to about 45% by weight inorganic particulate material, or from about 30 to about 45% by weight inorganic particulate material, or from about 35 to about 45% by weight inorganic particulate material or from about 20 to about 40% by weight inorganic particulate material, or from about 30 to about 50% by weight inorganic particulate material, or from about 30 to about 40% by weight inorganic particulate material, or from about 40 to about 50% by weight inorganic particulate material.

The paper product may comprise other optional additives including, but not limited to, dispersant, biocide, suspending aids, salt(s) and other additives, for example, starch or carboxy methyl cellulose or polymers, which may facilitate the interaction of mineral particles and fibres.

Also provided is a papermaking composition which can be used to prepare the paper products of the present invention.

In a typical papermaking process, a cellulose-containing pulp is prepared by any suitable chemical or mechanical treatment, or combination thereof, which are well known in the art. The pulp may be derived from any suitable source such as wood, grasses (e.g., sugarcane, bamboo) or rags (e.g., textile waste, cotton, hemp or flax). The pulp may be bleached in accordance with processes which are well known to those skilled in the art and those processes suitable for use in the present invention will be readily evident. The bleached cellulose pulp may be beaten, refined, or both, to a predetermined freeness (reported in the art as Canadian standard freeness (CSF) in $cm^3$). A suitable paper stock is then prepared from the bleached and beaten pulp.

The papermaking composition of the present invention comprises suitable amounts of high energy TMP, low energy TMP, microfibrillated cellulose, optional inorganic particulate material, and optional other conventional additives known in the art, to obtain a paper product according to the invention therefrom.

The papermaking composition may also contain a non-ionic, cationic or an anionic retention aid or microparticle retention system in an amount in the range from about 0.01 to 2% by weight, based on the weight of the paper product. Generally, the greater the amount of inorganic particulate material, the greater the amount of retention aid. It may also contain a sizing agent which may be, for example, a long chain alkylketene dimer, a wax emulsion or a succinic acid derivative. The papermaking composition may also contain dye and/or an optical brightening agent. The papermaking composition may also comprise dry and wet strength aids such as, for example, starch or epichlorhydrin copolymers.

Paper products according to the present invention may be made by a process comprising: i) combining high energy TMP, low energy TMP, microfibrillated cellulose, optional inorganic particulate material and other optional additives (such as, for example, a retention aid, and other additives such as those described above) in appropriate amounts to form a papermaking composition; (ii) forming a paper product from said papermaking composition, and optionally (iii) calendering and optionally supercalendering the paper product.

In certain embodiments, the paper product may be coated with a coating composition prior to calendering and optionally supercalendaring.

The coating composition may be a composition which imparts certain qualities to the paper, including weight, surface gloss, smoothness or reduced ink absorbency. For example, a kaolin- or calcium carbonate-containing composition may be used to coat the paper product paper. A coating composition may include binder, for example, styrene-butadiene latexes and natural organic binders such as starch. The coating formulation may also contain other known additives for coating compositions. Exemplary additive are described in WO-A-2010/131016 from page 21, line 15 to page 24, line 2.

Methods of coating paper and other sheet materials, and apparatus for performing the methods, are widely published and well known. Such known methods and apparatus may conveniently be used for preparing coated paper. For example, there is a review of such methods published in Pulp and Paper International, May 1994, page 18 et seq. Sheets may be coated on the sheet forming machine, i.e., "on-machine," or "off-machine" on a coater or coating machine. Use of high solids compositions is desirable in the coating method because it leaves less water to evaporate subsequently. However, as is well known in the art, the solids level should not be so high that high viscosity and leveling problems are introduced. The methods of coating may be performed using an apparatus comprising (i) an application for applying the coating composition to the material to be coated and (ii) a metering device for ensuring that a correct level of coating composition is applied. When an excess of coating composition is applied to the applicator, the metering device is downstream of it. Alternatively, the correct amount of coating composition may be applied to the applicator by the metering device, e.g., as a film press. At the points of coating application and metering, the paper web support ranges from a backing roll, e.g., via one or two applicators, to nothing (i.e., just tension). The time the coating is in contact with the paper before the excess is finally removed is the dwell time—and this may be short, long or variable.

The coating is usually added by a coating head at a coating station. According to the quality desired, paper grades are uncoated, single-coated, double-coated and even triple-coated. When providing more than one coat, the initial coat (precoat) may have a cheaper formulation and optionally coarser pigment in the coating composition. A coater that is applying coating on each side of the paper will have two or four coating heads, depending on the number of coating layers applied on each side. Most coating heads coat only one side at a time, but some roll coaters (e.g., film presses, gate rolls, and size presses) coat both sides in one pass.

Examples of known coaters which may be employed include, without limitation, air knife coaters, blade coaters, rod coaters, bar coaters, multi-head coaters, roll coaters, roll or blade coaters, cast coaters, laboratory coaters, gravure coaters, kisscoaters, liquid application systems, reverse roll coaters, curtain coaters, spray coaters and extrusion coaters.

Water may be added to the solids comprising the coating composition to give a concentration of solids which is preferably such that, when the composition is coated onto a sheet to a desired target coating weight, the composition has a rheology which is suitable to enable the composition to be coated with a pressure (i.e., a blade pressure) of between 1 and 1.5 bar.

Calendering is a well known process in which paper smoothness and gloss is improved and bulk is reduced by passing a coated paper sheet between calender nips or rollers one or more times. Usually, elastomer-coated rolls are employed to give pressing of high solids compositions. An elevated temperature may be applied. One or more (e.g., up to about 12, or sometimes higher) passes through the nips may be applied.

Supercalendering is a paper finishing operation consisting of an additional degree of calendaring. Like calendaring, supercalendering is a well known process. The supercalender gives the paper product a high-gloss finish, the extent of supercalendering determining the extent of the gloss. A typical supercalender machine comprises a vertical alternating stack of hard polished steel and soft cotton (or other resilient material) rolls, for example, elastomer-coated rolls. The hard roll is pressed heavily against the soft roll, compressing the material. As the paper web passes through this nip, the force generated as the soft roll struggles to return to its original dimensions "buffs" the paper, generating the additional luster and enamel-like finish typical of supercalendered paper.

The steps in the formation of a final paper product from a papermaking composition are conventional and well know in the art and generally comprise the formation of paper sheets having a targeted basis weight, depending on the type of paper being made.

As discussed above, paper products of the present invention have surprisingly been found to exhibit acceptable physical and mechanical properties, despite replacement of conventional high energy TMP with an amount of low energy TMP. The expected decline in physical and mechanical properties (attributable to the replacement of a portion of high energy TMP with lower energy TMP) may be ameliorated or offset by the addition of an amount of microfibrillated cellulose, as described herein. Thus, paper products can be prepared using relatively less energy and at relatively less cost.

Thus, in certain embodiments, the paper product has a porosity, for example, Bendsten porosity measured using a Bendsten Model 5 porosity tester in accordance with SCAN P21, SCAN P60, BS 4420 and Tappi UM 535, which is less than the porosity of a comparable paper product which does not comprise microfibrillated cellulose as described herein.

In certain embodiments, the paper product has a strength which is greater than the strength of a comparable paper product which does not comprises microfibrillated cellulose as described herein. The strength may be one or both of burst strength measured using a Messemer Buchnel burst tester according to SCAN P24, or MD tensile strength measured using a Testometrics tensile according to SCAN P16.

In certain embodiments, the paper product has a Bendsten porosity of less than about 300 $cm^3$ $min^{-1}$, for example, less than about 250 $cm^3$ $min^{-1}$, or less than about 200 $cm^3$ $min^{-1}$. Following calendaring, the paper product may have a Bendsten porosity of less than about 100 $cm^3$ $min^{-1}$, for example, less than about 75 $cm^3$ $min^{-1}$, or less than about 50 $cm^3$ $min^{-1}$, or less than about 20 $cm^3$ $min^{-1}$.

In certain embodiments, the paper product has a Burst strength index of at least about 0.65 kPa $m^2$ $g^{-1}$, for example, at least about 0.7 kPa $m^2$ $g^{-1}$, or at least about 0.75 kPa $m^2$ $g^{-1}$, or at least about 0.77 kPa $m^2$ $g^{-1}$.

In certain embodiments, the paper product has a MD Tensile strength index of at least about 22 Nm $g^{-1}$, for example, at least about 22.5 Nm $g^{-1}$, or at least about 23.0 Nm $g^{-1}$.

In certain embodiments, the paper product has a Bulk (reciprocal of the apparent density as measured according to SCAN P7) which is greater than the Bulk of a comparable paper product which comprises high energy TMP and microfibrillated cellulose as described herein, but no low energy TMP as described herein.

Embodiments of the present invention will now be described by way of illustration only, with reference to the following examples.

EXAMPLES

Example 1—Preparation of Microfibrillated Cellulose

A composition comprising microfibrillated cellulose and kaolin was prepared by microfibrillating pulp in a stirred media detritor (SMD) in the presence of the kaolin and grinding medium.

The grinder was a 185 kW Bottom Screened SMD. The screen was a 1 mm wedge wire slotted screen.

Disintegrated unrefined Botnia RM90 Northern bleached softwood pulp and kaolin (particle size (wt. %<2 μm): 60) was added to the SMD with water to give a total volume of 1000 liters. The weight ratio of pulp to kaolin was 20:80. To the feed mix was added 2.55 tonnes of grinding media. Grinding was continued until the energy input was 3000 kWh/t of fibre. At the end of the grind, the product was separated from the media through the screen. The co-process material had properties as summarized in Table 1.

TABLE 1

| Solids (%) | Fibre (pulp_content of solids) (%) | Fibre $d^{50}$ (μm) | Fibre steepness (μm) | Brookfield viscosity (mPas) (10 rpm) at 1.5% fibre solids |
|---|---|---|---|---|
| 5.1 | 18.7 | 178 | 33.7 | 9200 |

Example 2—Preparation of Pulp Furnishes for Paper Sheet Manufacture

A series of pulp furnishes were prepared as follows:

1) a blend comprising 90 parts high energy TMP (total energy input of about 2.8 $MWht^{-1}$) having a freeness of 30-40 $cm^3$ CSF and 10 parts Botnia RM90 chemical pine pulp refined at 100 $kWht^{-1}$ and a specific edge load of 2.5 $Wsm^{-1}$ to a freeness of 28° Shcopper Reigler (SR)
2) a blend comprising 45 parts of the high energy TMP as in (1), 45 parts low energy (total energy input of about 1.8 $MWht^{-1}$) newsprint TMP having a freeness of 100-110 $cm^3$ CSF, and 10 parts refined Botnia chemical pine pulp as in (1)
3) a blend comprising 90 parts of the low energy newsprint TMP as in (2) and 10 parts refined Botnia chemical pine pulp as in (1)

Example 3—Preparation of Uncalendered Papers

Paper reels were produced on a pilot scale Fourdrinier paper machine using a furnish blend comprising the pulp blends of Example 2 combined with the co-processed microfibrillated cellulose (MFC)/kaolin material prepared in Example 1. The amounts of the furnish blend and co-processed material were selected to give nominal microfibrillated cellulose levels in the sheets from 1-3 wt. % and a mineral loading between 35 and 55 wt. %. This was adjusted by blending the co-processed MFC/kaolin blend of Example 1 with different amounts of additional kaolin (particle size (wt. %<2 μm): 60). For each sheet the target grammage was 55 $gm^{-2}$ and the machine run until equilibrated with a recirculating white water system at a speed of 12 m $min^{-1}$. The retention aid was BASF Percol 830 (cationic polyacrylamide) added at a dose of 0.02 wt % on the dry weight of furnish.

Raw data in the form of uncalendered paper properties vs. loading were obtained. Interpolated properties at 40 wt. % mineral loading were plotted as a function of microfibrillated cellulose added to the sheet. Results are summarized in Table 2.

Paper D is of the invention. Papers A, B, C, E and F are provided for comparison.

Test methods:

Burst strength: Messemer Büchnel burst tester according to SCAN P 24.

MD Tensile strength: Testometrics tensile tester according to SCAN P 16.

Bendtsen porosity: Measured using a Bendtsen Model 5 porosity tester in accordance with SCAN P21, SCAN P60, BS 4420 and Tappi UM 535.

Bulk: This is the reciprocal of the apparent density as measured according to SCAN P7.

Bendsten smoothness: SCAN P 21:67

TABLE 2

| | wt. % high energy TMP in furnish | wt. % low energy TMP in furnish | wt. % MFC in sheet | Burst index, kPa $m^2$ $g^{-1}$ | MD Tensile index, Nm $g^{-1}$ | Bendtsen porosity, $cm^3$ $min^{-1}$ | Bendtsen smoothness, $cm^3$ $g^{-1}$ | Bulk, $cm^3$ $g^{-1}$ |
|---|---|---|---|---|---|---|---|---|
| Paper A | 90 | 0 | 0 | 0.82 | 24.5 | 177 | 675 | 1.84 |
| Paper B | 90 | 0 | 2 | 0.93 | 26.4 | 110 | 615 | 1.70 |
| Paper C | 45 | 45 | 0 | 0.70 | 21.8 | 360 | 745 | 1.91 |
| Paper D | 45 | 45 | 2.6 | 0.78 | 23.0 | 175 | 730 | 1.79 |
| Paper E | 0 | 90 | 0 | 0.52 | 16.9 | 780 | 815 | 2.02 |
| Paper F | 0 | 90 | 2.6 | 0.64 | 20.5 | 320 | 850 | 1.90 |

The invention claimed is:

1. A process for preparing a paper product, the process comprising: (i) combining high energy thermomechanical pulp (TMP), low energy TMP, and microfibrillated cellulose in appropriate amounts to form a papermaking composition; and (ii) forming the paper product from the papermaking composition; wherein the paper product comprises at least about 30% by weight high energy TMP and low energy and between 0.1% to 5% by weight of said microfibrillated cellulose TMP, based on the total weight of the paper product; wherein the weight ratio of high energy TMP to low energy TMP is from about 55:45 to about 50:50; wherein the microfibrillated cellulose has a fibre steepness of from about 20 to about 50; wherein the low energy TMP has a Canadian standard freeness of from about 80 to about 130 $cm^3$, and wherein the high energy TMP has a Canadian standard freeness of from 10 to 60 $cm^3$; further wherein the paper product has a Bendtsen porosity of less than about 300 $cm^3$ $min-^1$.

2. The process of claim 1, further comprising combining inorganic particulate material with the high energy TMP, low energy TMP, and microfibrillated cellulose in appropriate amounts to form the papermaking composition.

3. The process of claim 2, wherein the papermaking composition comprises up to about 50% by weight of the inorganic particulate material.

4. The process of claim 3, wherein the inorganic particulate material is selected from the group consisting of at least one of an alkaline earth metal carbonate or sulphate, calcium carbonate, magnesium carbonate, dolomite, gypsum, a hydrous kandite clay, kaolin, halloysite, ball clay, anhydrous kandite clay, metakaolin, fully calcined kaolin, talc, mica, perlite, diatomaceous earth, magnesium hydroxide, aluminium trihydrate, and combinations thereof.

5. The process of claim 2, wherein the inorganic particulate material is kaolin.

6. The process of claim 5, wherein at least about 50% by weight of the kaolin has an equivalent spherical diameter of less than about 2 μm.

7. The process of claim 6, wherein the kaolin has at least one of a shape factor of from about 10 to about 70.

8. The process of claim 1, further comprising at least one of calendering and supercalendering the paper product.

9. The process of claim 8, wherein the paper product formed is coated with a coating composition prior to the at least one of calendering and supercalendering.

* * * * *